United States Patent [19]

Eklund et al.

[11] 4,270,876

[45] Jun. 2, 1981

[54] METHOD OF LINING A VERTICAL MINE SHAFT WITH CONCRETE

[75] Inventors: James D. Eklund, Mattawa; Joseph M. Halter, Richland; Donald E. Rasmussen, Spokane; Robert G. Sullivan, Richland; Robert B. Moffat, Federal Way, all of Wash.

[73] Assignee: The United States of America as represented by the United States Department of Energy, Washington, D.C.

[21] Appl. No.: 107,792

[22] Filed: Dec. 27, 1979

[51] Int. Cl.[3] ..... E21D 9/00

[52] U.S. Cl. ..... 405/133; 405/142; 405/146; 425/59

[58] Field of Search ..... 405/133, 146, 142, 147, 405/141; 249/11; 425/63, 59; 175/171

[56] References Cited

U.S. PATENT DOCUMENTS

| | | | |
|---|---|---|---|
| 3,074,237 | 1/1963 | Lilly | 405/133 |
| 3,377,669 | 4/1968 | Burgess | 425/59 |
| 3,561,223 | 2/1971 | Tabor | 405/146 X |
| 3,788,087 | 1/1974 | Patin | 405/141 |
| 4,067,675 | 1/1978 | Hanson | 405/133 |
| 4,147,453 | 4/1979 | Unger et al. | 405/141 |
| 4,205,949 | 6/1980 | Hanson | 405/133 X |

*Primary Examiner*—Carl D. Friedman

*Attorney, Agent, or Firm*—Hugh W. Glenn; Robert J. Fisher; James E. Denny

[57] ABSTRACT

The apparatus includes a cylindrical retainer form spaced inwardly of the wall of the shaft by the desired thickness of the liner to be poured and having overlapping edges which seal against concrete flow but permit the form to be contracted to a smaller circumference after the liner has hardened and is self-supporting. A curb ring extends downwardly and outwardly toward the shaft wall from the bottom of the retainer form to define the bottom surface of each poured liner section. An inflatable toroid forms a seal between the curb ring and the shaft wall. A form support gripper ring having gripper shoes laterally extendable under hydraulic power to engage the shaft wall supports the retainer form, curb ring and liner until the newly poured liner section becomes self-supporting. Adjusting hydraulic cylinders permit the curb ring and retainer form to be properly aligned relative to the form support gripper ring. After a liner section is self-supporting, an advancing system advances the retainer form, curb ring and form support gripper ring toward a shaft boring machine above which the liner is being formed. The advancing system also provides correct horizontal alignment of the form support gripper ring.

26 Claims, 17 Drawing Figures

FIG 2
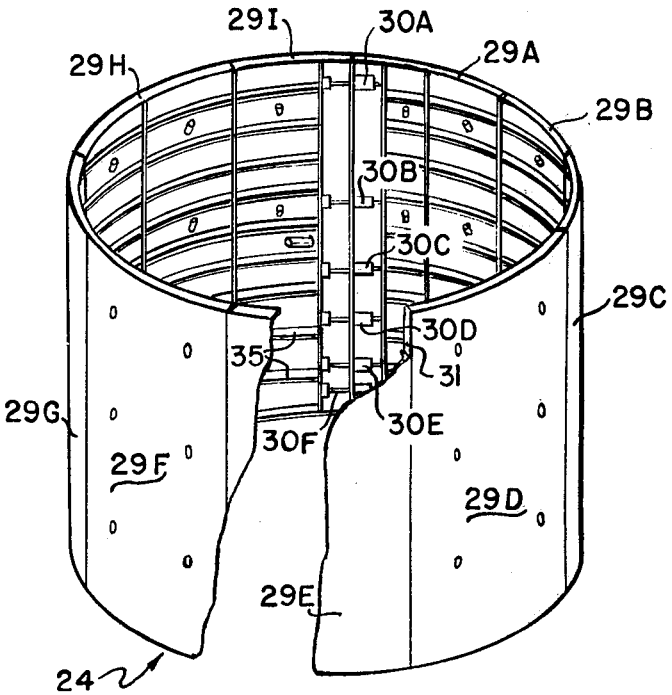
FIG 8
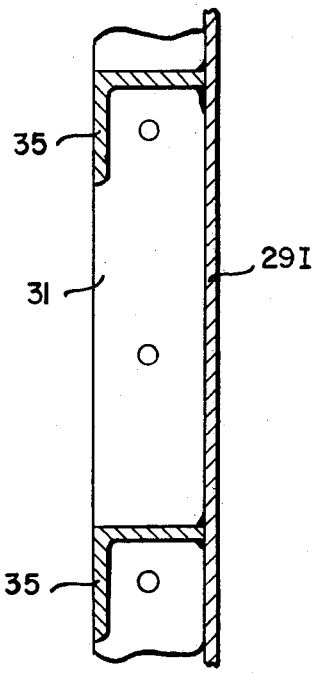
FIG 9
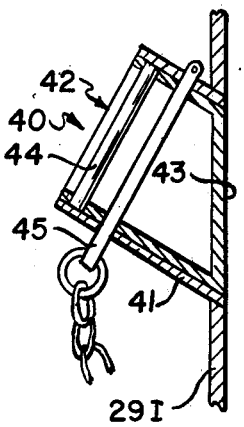
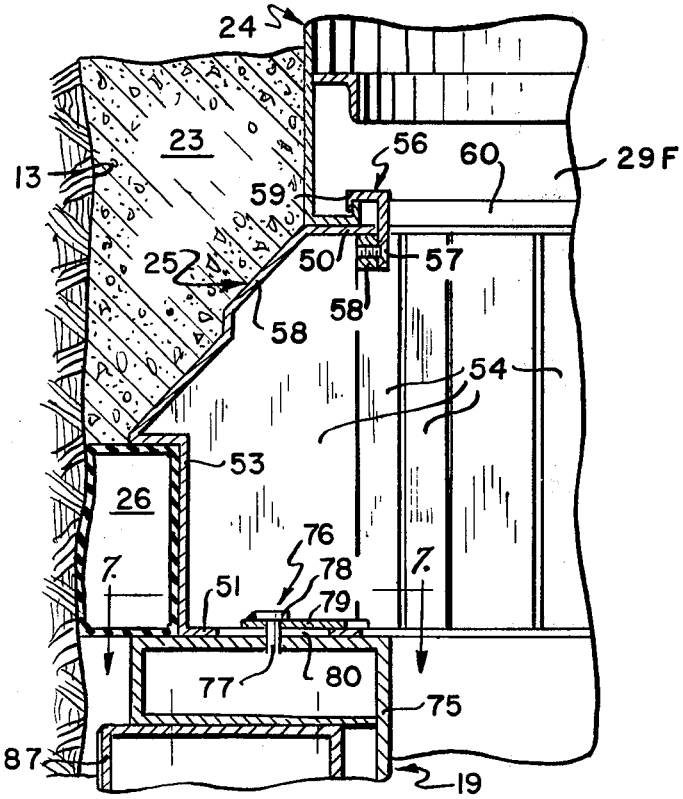
FIG 6
FIG 7
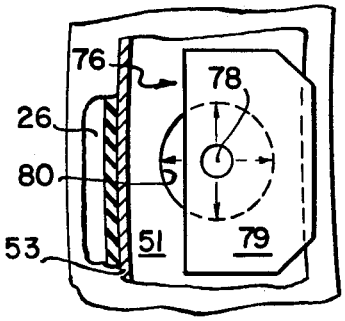

FIG. 3
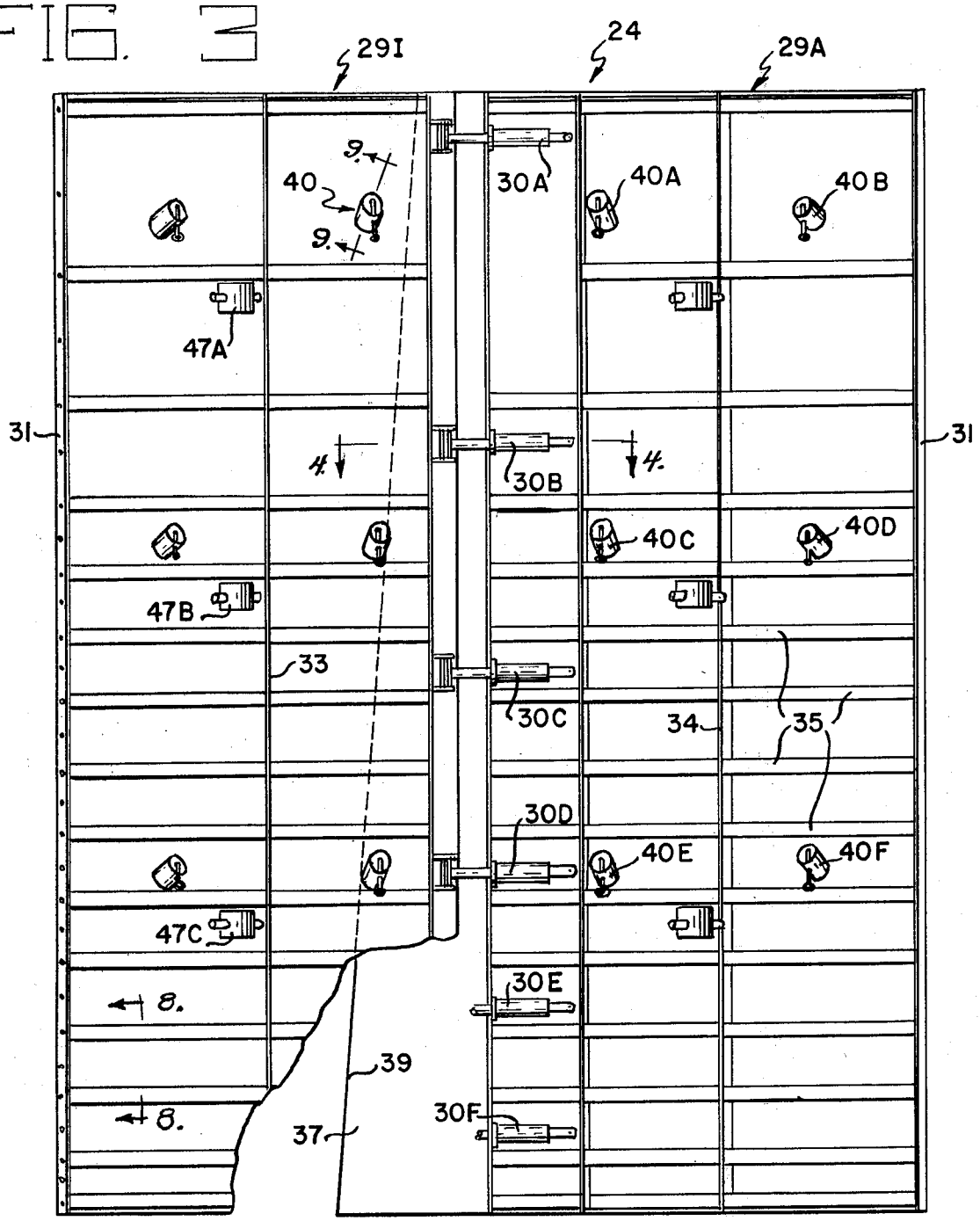
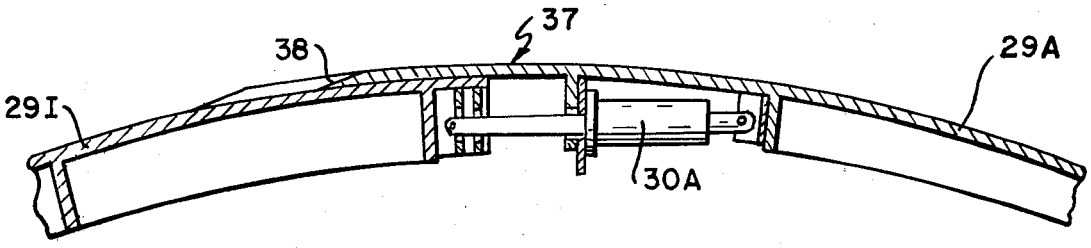
FIG 4

FIG 11
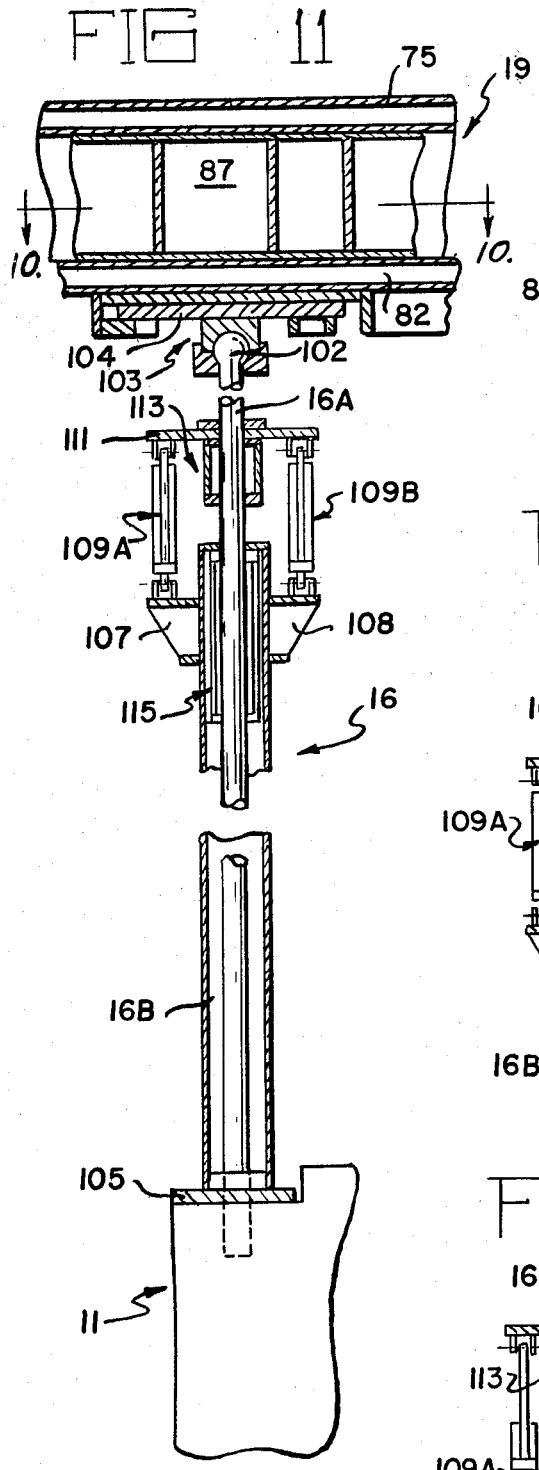
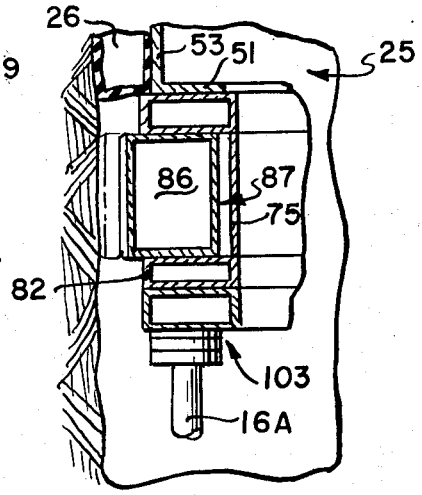
FIG 12
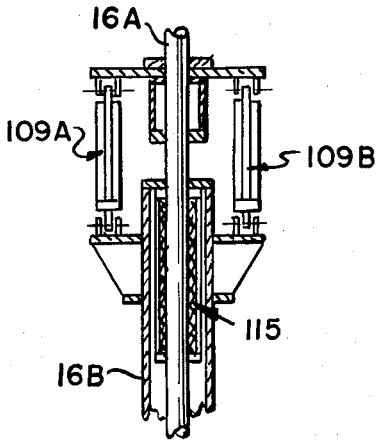
FIG 13
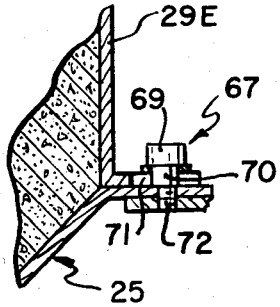
FIG 14
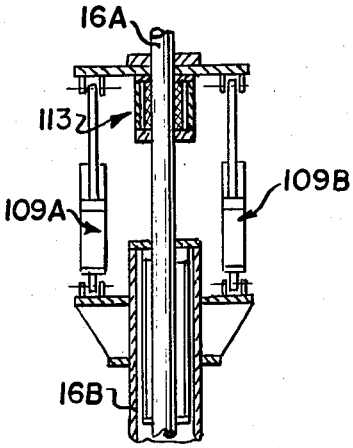
FIG 15
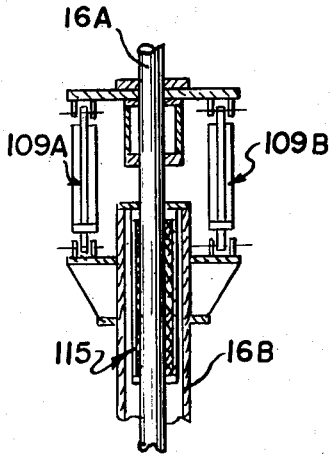
FIG 16

METHOD OF LINING A VERTICAL MINE SHAFT WITH CONCRETE

CONTRACTUAL ORIGIN OF THE INVENTION

The invention described herein was made in the course of, or under, a contract with the UNITED STATES DEPARTMENT OF ENERGY.

BACKGROUND OF THE INVENTION

The present invention is directed to a method of and apparatus for forming concrete liner in a vertical shaft; particularly where the diameter of the bore is large. For example, the disclosed embodiment may form a liner for a shaft in a coal mine wherein the inner diameter of the shaft after the lining is installed in twenty-two feet. The method and apparatus have application beyond the field of coal mining, but as indicated above, it has particular application in the formation of liners for shafts of large diameter.

A current technique for lining large diameter bores with concrete requires that forms be set for a curb ring located at a distance beneath a previously formed curb ring. The new curb ring is then formed by pouring concrete into the forms. Next, forms are placed between the two curb rings, spaced inwardly from the wall of the shaft by the desired thickness of the liner section; and that liner section is poured. A new curb ring is formed at a lower depth, again by setting suitable forms in pouring the new curb ring. Finally, the liner forms are disassembled from the most recently poured section and re-assembled at the lower level. The process is continued until the liner is completely formed.

SUMMARY OF THE INVENTION

The present invention is designed for cooperation with the shaft boring machine, sometimes referred to as a "blind shaft borer" so that the shaft lining can be formed concurrently with shaft boring. This avoids any limitation on the boring rate of the machine, and it takes advantage of technological advances in quick-setting concrete which is now commercially available.

The apparatus includes a cylindrical retainer form spaced inwardly of the wall of the shaft by the desired thickness of the liner to be poured and having overlapping edges which seal against concrete flow. The overlapped edges are connected by hydraulic cylinders which permit the retainer form to be contracted approximately two inches in diameter (six inches in circumference) from a nominal diameter of twenty-two feet. The end of the outer lap edge is beveled and cut on an edge bias to break concrete away from the retainer form when it is contracted.

A curb ring is attached to the bottom of the retainer form in such a way that the cylindrical retainer form can be extended and contracted as mentioned above, although the curb ring is not capable of being contracted in this manner. The curb ring has a general frusto-conical shape, extending downwardly and outwardly from the bottom of the retainer form to define the bottom surface of a poured liner section in such a manner that when a new section is formed, any trapped air is permitted to escape upwardly and toward the center of the shaft so that it cannot become trapped in the form.

The curb ring defines an angular recess for receiving an inflatable toroid which forms a seal between the curb ring and the shaft wall. With this structure, a separate curb ring of the type used in the prior method of forming shaft liners discussed above, is not necessary since each liner section is poured up to, and becomes continuous with, the previously poured liner section.

A gripper ring having laterally extendable gripper shoes is provided beneath the curb ring for selectively engaging the shaft wall and supporting the retainer ring, curb ring and the concrete liner, until the liner becomes self-supporting. Adjusting hydraulic cylinders permit the curb ring and retainer form to be properly relative to the form support gripper ring. The form support gripper ring, in turn, is adjustable so that it lies in a horizontal plane by means of the form advancing system.

Alignment of the form is accomplished by means of a laser system which is used by the boring machine in its operation. The laser is located at ground level above the shaft. Preferably, two lasers are used, each transmitting a light beam down a tube embedded in the liner sections. The laser tubes extend through and are sealed with the curb ring beneath the retainer form. As the form is advanced, the curb ring slides along a new section of laser tube.

The advancing system includes upright columns which are selectively locked either to the form support gripper ring or a gripper ring on the shaft boring machine beneath the liner being formed. Vertically extendable hydraulic cylinder units are also included in the advancing system. These vertical hydraulic cylinders perform a number of functions. First, their rod ends are connected to the form support gripper ring and position it in a horizontal plane. Further, they permit the boring machine to advance while a liner section hardens, and when they are retracted, they lower the retainer form toward the boring machine, thereby advancing it down the shaft.

In operation, after a boring cycle is completed and a previously formed liner section is self-supporting, the gripper ring of the boring machine grips the shaft wall. At this time, the form support gripper ring is also gripping the shaft wall so that it is self-supporting. The columns are locked to the boring machine gripper ring and the form support gripper ring is released, thereby transferring the weight of the retainer form (including the curb ring and form support gripper ring) to the boring machine gripper ring through the support columns.

The vertical hydraulic cylinders are then extended and their rod ends are locked to the support columns. The butt or cylinder ends of the vertical hydraulic units are connected to the gripper ring of the boring machine. When the vertical cylinders are fully extended, the rod ends of the cylinders are locked to the support columns by what are referred to as upper locks, and the previously mentioned locks (called "lower locks") are released, thereby transferring the weight of the retainer form to the boring machine gripper ring through the upper locks and the extended vertical hydraulic cylinder. The cylinder may then be retracted (after the form is retracted and the seal deflated so that the form is broken free of the previously formed liner section) to thereby lower the retainer form, curb ring, and form support gripper ring. The advancing cycle may be repeated until the form has been advanced a desired amount to form a new liner section.

The present invention thus cooperates with a boring machine to permit a liner to be formed behind the boring machine as it progresses in the formation of a vertical shaft. It does so without having to form up and pour separate curb rings between liner sections and without having to disassemble and re-assemble forms for each liner section.

Other features and advantages of the present invention will be apparent to persons skilled in the art from the following detailed description of a preferred embodiment accompanied by the attached drawing wherein identical reference numerals will refer to like parts in the various views.

DESCRIPTION OF THE FIGURES

FIG. 2 is an upper perspective view of a cylindrical, expandable concrete retainer form incorporated in the present invention, with a portion of the near side of the form broken away;

FIG. 3 is a plan view of overlapped sections of the retainer form of FIG. 2 taken from inside the form, and with the lower portion of the left panel broken away;

FIG. 4 is a close-up fragmentary horizontal cross-sectional view of the overlapped panels of FIG. 3, taken along the sight line 3—3;

FIG. 6 is a close-up vertical cross-sectional fragmentary view showing the curb ring and its connection to the retainer form and the form support gripper ring, together with an inflatable seal;

FIG. 7 is a fragmentary plan view showing one of the connectors between the curb ring and the form support gripper ring taken through the sightline 7—7 of FIG. 6;

FIG. 8 is a fragmentary vertical cross-sectional view of a portion of the end panel of the retainer form taken through the sight line 8—8 of FIG. 3 and showing the vertical and horizontal stiffeners;

FIG. 9 is a vertical cross-sectional view taken through the sight line 9—9 of FIG. 3 and illustrating a fill port for pouring the concrete to form a liner;

FIG. 11 is a fragmentary vertical view, partly in cross section, a column assembly;

FIG. 12 is a close-up fragmentary transverse cross-sectional view of the gripper ring;

FIG. 13 is a close-up fragmentary vertical cross-sectional view of a pivot connection between the bottom of the retainer form and the curb ring opposite the expansion cylinders;

FIGS. 14, 15, and 16 are vertical fragmentary views illustrating the hydraulic cylinders and column locks of the advancing system during progressive stages of one cycle of advancing the retainer form.

GENERAL DESCRIPTION OF THE INVENTION

Figure 1:
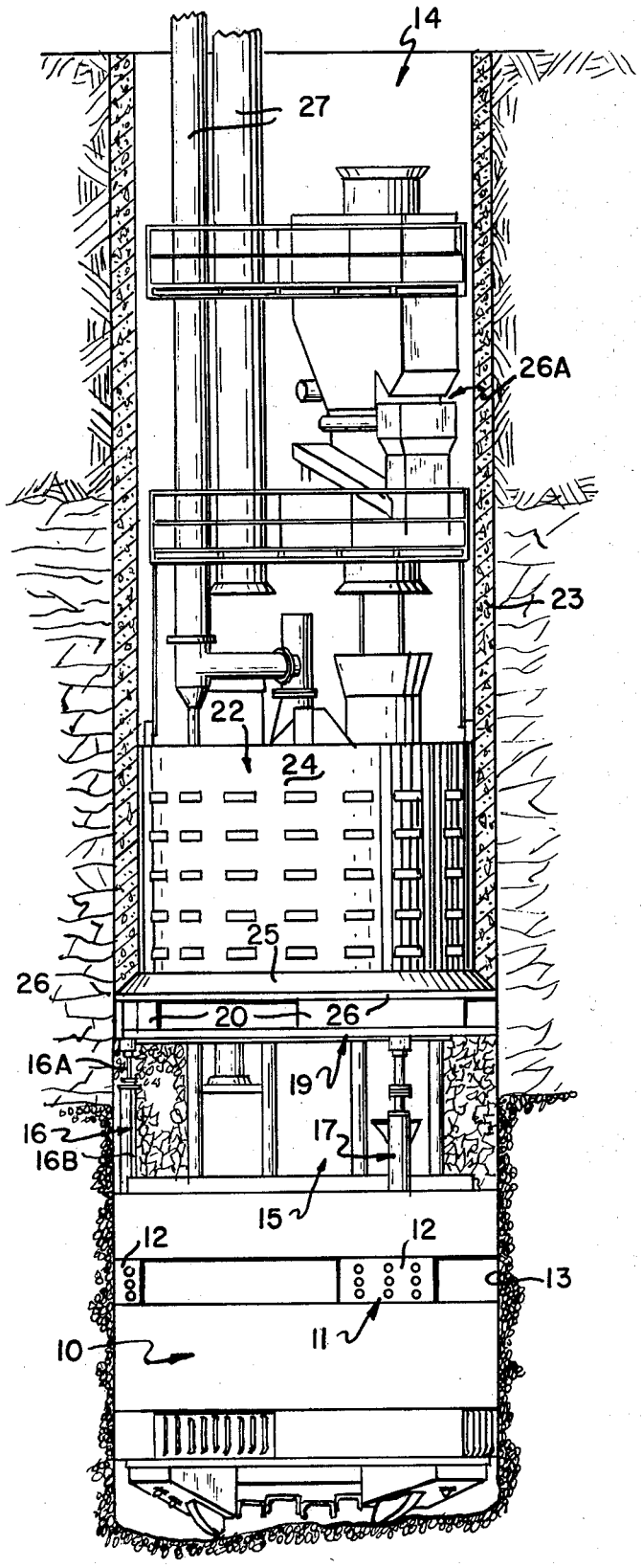
FIG. 1 is an elevational view, partly in cross section, of a shaft boring machine and apparatus forming a concrete liner behind the machine according to the present invention.

Referring first to FIG. 1, reference numeral 10 generally designates a blind shaft borer. The borer may be of the type made by The Robbins Company of Seattle, Wash., model #241SB-184, with minor modifications to be described below. The blind shaft borer includes a gripper ring generally designated 11 including shoes 12 designed to be expanded against a wall 13 of a vertical shaft generally designated 14 for securing the borer and providing independent support.

Above the blind shaft borer is an advancing assembly generally designated 15 and including three equally angularly spaced column support and locking assemblies, two of which are shown in FIG. 1 and designated respectively 16 and 17. Each of the column support and locking assemblies are similar in structure and operation, so only one need be described in detail for a full understanding. However, each of the column support and locking assemblies may be independently operated to achieve a horizontal level of a form support gripper ring generally designated 19 and located immediately above the column support and locking assemblies. The column support and locking assemblies will be described in more detail below, but for a general understanding, the column support and locking assembly 16 is seen to include a column 16A which is telescopically received in a spacer tube 16B. The top of the column 16A is connected to the bottom of the form support gripper ring 19; and the bottom of the spacer tube 16B is connected to the gripper ring 11 of the blind shaft borer 10.

The form support gripper ring 19 also includes gripper shoes 20 which may be extended laterally under force of a hydraulic actuator for gripping the wall 13 of the shaft; and when in such gripping relation, the gripper ring 19 supports a retainer form assembly generally designated 22 as well as the weight of any recently poured concrete forming the liner 23 which may not as yet have hardened and be self-supporting.

The principal elements of the retainer form assembly 22 are a cylindrical retainer form 24 and a curb ring 25. The curb ring 25 is connected and supported directly by the gripper ring 19; and the retainer form 24 is connected to and carried by the curb ring 25, but the connection is such as to permit the cylindrical retainer form (which has an overlapped edge as will be described) to be expanded and contracted by hydraulic cylinders to change its circumference without changing the circumference of the curb ring.

An inflatable bladder 26 forms a seal against the flow of concrete between the curb ring 25 and the wall 13 of the shaft.

Above the retainer form assembly is a separately suspended platform generally designated 26A which is sometimes referred to as a "Galloway stage". It has two decks and contains supplies for downhole batching, mixing and distribution of the concrete. Such equipment is known and generally used in this industry. Also illustrated in FIG. 1 are ventilation ducts generally designated 27.

With this general description, it can be understood that a principal object of the invention is to provide for the formation of the concrete liner in discrete segments which may have a variable axial length, and particularly to provide these segments at a rate that will equal the advance rate of the blind shaft borer 10 so that it can continue to operate at its normal advance rate without causing an increasing gap between the bottom of the shaft and the bottom of the liner. In this connection, it is important to use a suitable mix employing a quick setting concrete, such as is available under the trademark "VHE" from U.S. Gypsum Co.

The invention makes use of the availability of high early strength concrete which becomes self-supporting at an early stage. The invention will permit a blind shaft borer to advance at a rate of fifty feet per day to depths of two thousand feet while allowing no more than twenty-five feet of unlined shaft to remain above the borer at any time. The diameter of the unlined shaft may vary between twenty-four feet, three and one-half inches and twenty-four feet, five inches depending upon the condition of the cutters. The inner diameter of the lined shaft is twenty-two feet. It is desirable that the diameter of the lined shaft not vary from a true circle by more than one inch (plus or minus) on radius, and that the center of the bored shaft not vary more than three inches from the desired true shaft center.

The present invention is thus directed to the retainer form assembly 22 which provides the form for holding a concrete liner section until the concrete is self-supporting, the form support gripper ring 19 which supports the retainer form assembly and newly poured concrete, and the advancing assembly 15 which incrementally advances the retainer form assembly so that it can match the advance rate of the blind shaft borer, together with the hydraulic means for performing the required functions, and the overall method of operating the apparatus to form the liner in accordance with the advance rate of the line shaft borer.

DETAILED DESCRIPTION OF THE INVENTION

A. Expandable Retainer Form

Turning now to FIG. 2, the retainer form 24 comprises nine individual semi-cylindrical sections designated respectively 29A-29I. Each panel has a cord distance of nine feet six inches for convenience of shipping. Panels 29A and 29I overlap, as best seen in FIG. 4; and they are connected by six hydraulic cylinder and piston rod units designated respectively 30A-30F, as seen best in FIGS. 2 and 3.

Each of the nine panels of the retainer form may be fabricated from structural steel plate (or "sheath") having a thickness of one-quarter inch and a height of seventeen feet, rolled to an outside diameter of twenty-two feet.

The side (vertical) edges of intermediate panels 29B-29H are provided with a connecting flange welded in place to permit the panels to be connected by means of bolts. End panels 29A and 29I have similar connecting flanges adjacent panels 29B and 29H respectively to which they are connected, see the vertical connecting flange designated 31 in FIG. 3 for connecting panel 29I to panel 29H.

Each panel is reinforced by a central vertical stiffener, such as those designated 33 and 34 in FIG. 3 (the connecting flanges also act as vertical stiffeners), as well as a plurality of ring stiffeners (in the form of angle irons) such as those designated 35 in FIGS. 4 and 8.

Referring particularly to FIGS. 3 and 4, the outer sheath of panel 29A overlaps the panel 29I as indicated at 37. The sheath of panel 29A forms the outer lap, and the sheath of panel of 29I forms the inner lap.

A seal against concrete flow is formed by engagement of the overlap portion of these two panels; and the edge of the outer lap (panel 29A) is beveled as at 38 in FIG. 4 to form a knife edge. Further, this knife edge is cut on a bias relative to the vertical is indicated at 39 in FIG. 3; and its leading edge lies flush against the outer surface of the inner lap panel 29I, as best seen in FIG. 4. Thus, the knife edge sheers residual concrete from the outer surface of panel 29I when the cylinders 30A-30F are retracted.

Each of the cylinders 30A-30F is provided with a check valve to hold it in the expanded position so that the retainer form will not collapse should hydraulic pressure accidently be lossed. When the cylinders are contracted, they reduce the diameter of the retainer form by approximately two inches (or six inches in circumference). The throw of the hydraulic cylinders limits the expansion and contraction of the retainer form.

Each of the nine panels 29A-29I has six concrete fill ports. The fill ports for panel 29A are designated respectively 40A-40F. There are two fill ports five feet above the bottom of each panel, two at ten feet above the bottom of each panel, and two at fifteen feet above the bottom of each panel. Thus, there are eighteen fill ports at each of the three levels. Each fill port is separated from the adjacent one by a four feet circumferential distance, on center.

Each of the fill ports is similar in structure, such as the one designated 40 where the upper right-hand fill port on panel 29A or I, which is seen in cross section in FIG. 9. Turning then to FIG. 9, each fill port is provided with a fill pipe 41, which makes with the panel 29I such that the axis of the pipe 41 extends downwardly to permit any concrete in the pipe to drain into the space between the form and the wall of the shaft. The fill pipe 41 may be a standard four inch diameter schedule-80 fill pipe section, the distal end of which is machined to accept a conventional clamp-on coupling adapted to connect to a heavy rubber hose for transmitting concrete to the port.

A fill plug 42 is received in the pipe 41 for sealing it, and the plug 42 includes a sealing surface 43 which forms a continuation of the surface of the panel 29I.

Further, the plug 42 is provided with a handle 44 so that it may be removed; and it is held in place by means of a retainer pin 45 when it is desired to seal the port.

It is contemplated that two different techniques may be used for vibrating the concrete. The immersion vibrators are used during a concrete pour by inserting them into six fill ports to enhance the bond between the liner and the wall of the shaft. Further, the retainer forms may be vibrated by employing three panel vibrators for each of the panels, such as those designated 47A-47C for panel 29I. The panel vibrators consolidate the concrete near the fill ports and ensure a good bond to the previously poured section and to the wall of the shaft. The panel vibrators may be sychronized so that they pulse rotationally in sequence about the circumference of the form to reduce noise and to reduce the quantity of air needed to power the vibrators, which are pneumatically energized. Both types of vibrators mentioned are commercially available.

B. Curb Ring and Inflatable Seal

Referring back to FIG. 1, a curb ring 25 is located beneath the cylindrical retainer form 24; and it is seen in cross section in FIG. 6 to include an upper horizontal flange 50, a lower horizontal flange 51, a generally frusto-conical upper wall portion 52 extending downwardly and outwardly from the upper flange 50, and a wall portion 53 of inverted L-shape connecting the outboard edges of the frusto-conical portion 52 and the lower flange 51. These elements are braced at periodic intervals by means of gusset plates, one of which is designated 54. The wall portion 53 partially defines a recess for receiving the previously-mentioned inflatable seal 26 which is seen to take the form of a toroid having a generally rectangular cross section and forming a seal between the frusto-conical portion 52 of the curb ring and the wall 13 of the shaft.

The curb ring 25 is connected to the lower edge of the retainer form 24 by a number of hold-down clamps, one of which is seen in FIG. 6 and designated 56. The hold-down clamp 56 may be secured by means of a pair of threaded fasteners, one of which is designated 57 in FIG. 6 threaded into a cross bar 58 which may be welded to the bottom of an upper horizontal flange 50 of the curb ring and braced against the gusset 54, as illustrated.

Figure 5:
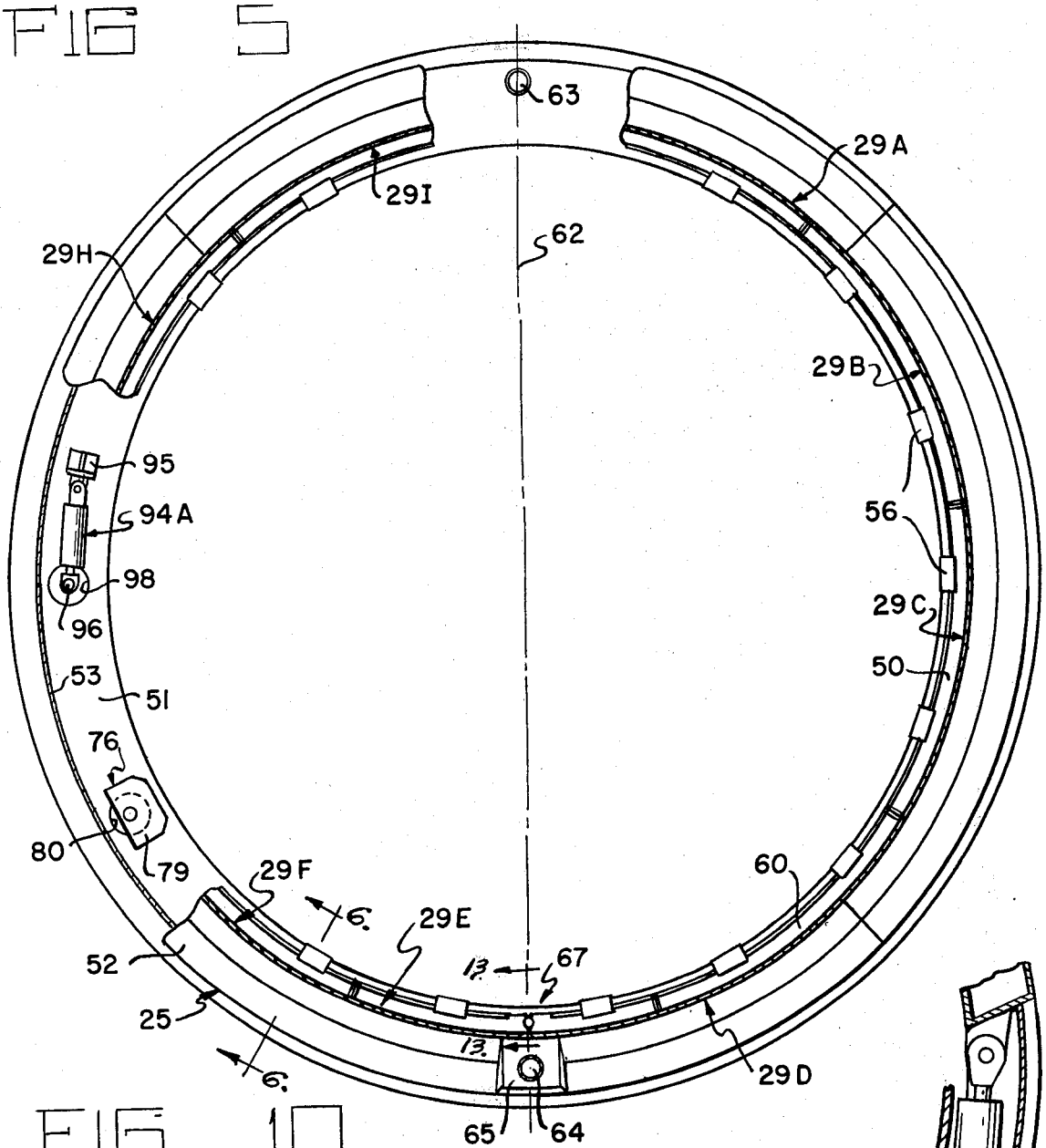
FIG. 5 is a top view showing the retainer form in horizontal cross section and partially broken away, a curb ring partially broken away and partly sectioned, and one of the adjusting cylinders for the curb ring.

The clamp 56 includes a retainer finger 59 which engages the angled lip 60 form at the bottom of each panel of the retainer form (the one in FIG. 6 being panel 29F as seen by referencing FIG. 5). This means of attachment of the curb ring to the retainer form permits the form to expand and contracts radially relative to the curb ring while properly positioning the bottom of the retainer form relative to the curb ring after the form has achieved its expanded condition.

Referring now to FIG. 5, there are eighteen hold-down clamps 56 for connecting the bottom of the retainer form to the curb ring; and they are located at angular separations of twenty degrees about the retainer form. A clamp is not located on the diameter which passes between the first panel 29A and the last panel 29I, this diameter being represented in FIG. 5 by the vertical chain line 62.

At diametrically opposite locations on the diameter 62, there are first and second laser tubes designated 63 and 64 respectively. The laser tubes are used for alignment purposes, as will be discussed. The laser tube 64 passes through a housing 65 formed in the curb ring 25 (the corresponding housing for laser tube 63 having been broken away for clarity). The laser tubes also extend through the gripper ring 19 and inwardly of the inflatable seal 26. The laser tubes are formed in shorter sections which may have a length of five feet and they are joined by couplings which permit the outer diameters of abutting ends to be smooth so that the junctions may pass through a seal secured to the bottom surface of the top plate of the housing 55 as the retainer form assembly 22 is advanced down the shaft. Such coupling may be accomplished either by an interior sleeve joining the abutting ends of tube sections, or by machining interlocking edges on the tube sections and joining them with a quick setting adhesive. Other suitable means may equally well be employed for this purpose.

Still referring to FIG. 5, at a location on the diameter 62 opposite that at which the panel sections 29A and 29I overlap, and between two of the hold-down clamps 56, there is a pivot connection generally designated 67 between the bottom of the retainer panel and the top flange 50 of the curb ring 25, and as seen in cross section in FIG. 13. The function of this pivot connection is to limit relative rotation between the curb ring and the expandable panel. The pivot connection includes a pin 69 having a shoulder portion 70 which is received in a slot 71 in the bottom flange of panel 29E. The slot 71 is elongated in a radial direction (see FIG. 5) but has a width slightly larger than the shoulder 70. This restrains lateral motion of panel 29E relative to the diameter lines 62, but permits the panel to move slightly in a radial direction, as may be required during an expansion or contraction cycle of the retainer panel. Returning to FIG. 13, the pin 69 extends through the flange 50 of the curb ring 25 and is secured by a threaded plate or nut 72.

C. Form Support Gripper Ring

The form support gripper ring 19, as seen in FIG. 1, is located beneath the curb ring 25 and connected to it. The form support gripper ring 19 includes an upper ring member 75 (seen in FIG. 6 to have a rectangular cross section) which is connected to the bottom flange 51 of the curb ring 25 by a connector generally designated 76. The connector 76 includes a pin 77 welded to the ring member 75 and having a head 78 which is secured to a plate 79 (see FIG. 7) which is located above the flange 51. The pin 76 extends through an enlarged circular opening 80 which is smaller in diameter than the length of the plate 79, as seen in FIG. 7. This connection, as will be discussed in more detail below, permits the curb ring (and bottom of retainer form) to be adjusted relative to the gripper ring 19 even though the gripper ring firmly engages the wall of the shaft.

In addition to the upper ring member 75, the gripper ring includes a lower ring member 82 (see FIGS. 10 and 12) which is connected to the upper ring 75 by curved plates 84 and vertical box beams 86 to form a rigid structure.

Figure 10:
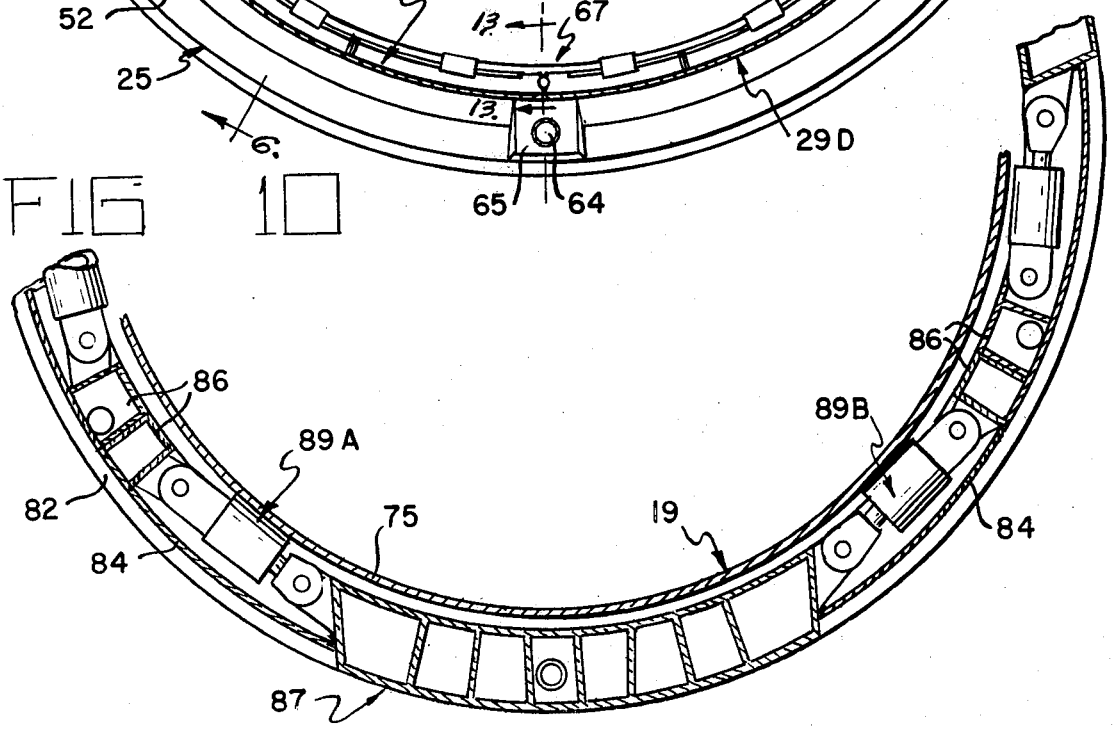
FIG. 10 is a fragmentary view of the form support gripper ring, shown partly in horizontal cross section and illustrating the expansion cylinders for the gripper shoes.

The plates 84 are separated to permit the gripper shoes, one of which is seen at 87 in FIG. 10 to extend radially outwardly of the upper and lower ring members 75, 82. Each shoe is provided with a pair of hydraulic cylinders 89A, 89B having their butt ends pivotally connected to ears welded to the box beams 86, and their rod ends pivotally connected to similar ears welded to the shoes 87. There are three gripper shoes 87, so there are six hydraulic cylinders for actuating them. These cylinders are designated 89A–89F in the schematic control diagram of FIG. 17.

D. Alignment Of Retainer Form

The gripper ring is aligned in a horizontal plane by hydraulic cylinders in the advancing system to be discussed below. Once it has achieved horizontal alignment, the hydraulic cylinders 89A–89F are extended so that the shoes 87 engage the inner wall of the shaft, as seen in phantom in FIG. 12, thereby stablizing the gripper ring. At this time the upper ends of the laser tubes 63, 64 will have been connected to the lower ends of the laser tube sections protruding beneath the liner section previously poured; and the lower ends of the laser tubes are held by the curb ring 25 (more particularly, by the seal through which they pass).

To complete the alignment of the lower ends of the laser tubes, four hydraulic cylinders spaced at ninety degree intervals are used. One of these cylinders is shown and designated 94A in FIG. 5. The butt end of the cylinder 94A is pivotally connected to an ear welded to a bracket 95 which, in turn, is welded to the lower horizontal flange 51 of the curb ring 25. The rod end of the cylinder 94A is pivotally connected to a pin 96 welded to the upper surface of the upper ring member 75 of the gripper ring assembly; and an aperture 98 is formed in the flange 51, similar to the previously described aperture 80 to maintain the connection while permitting relative adjustment motion between the curb ring and the gripper ring assembly.

Figure 17:
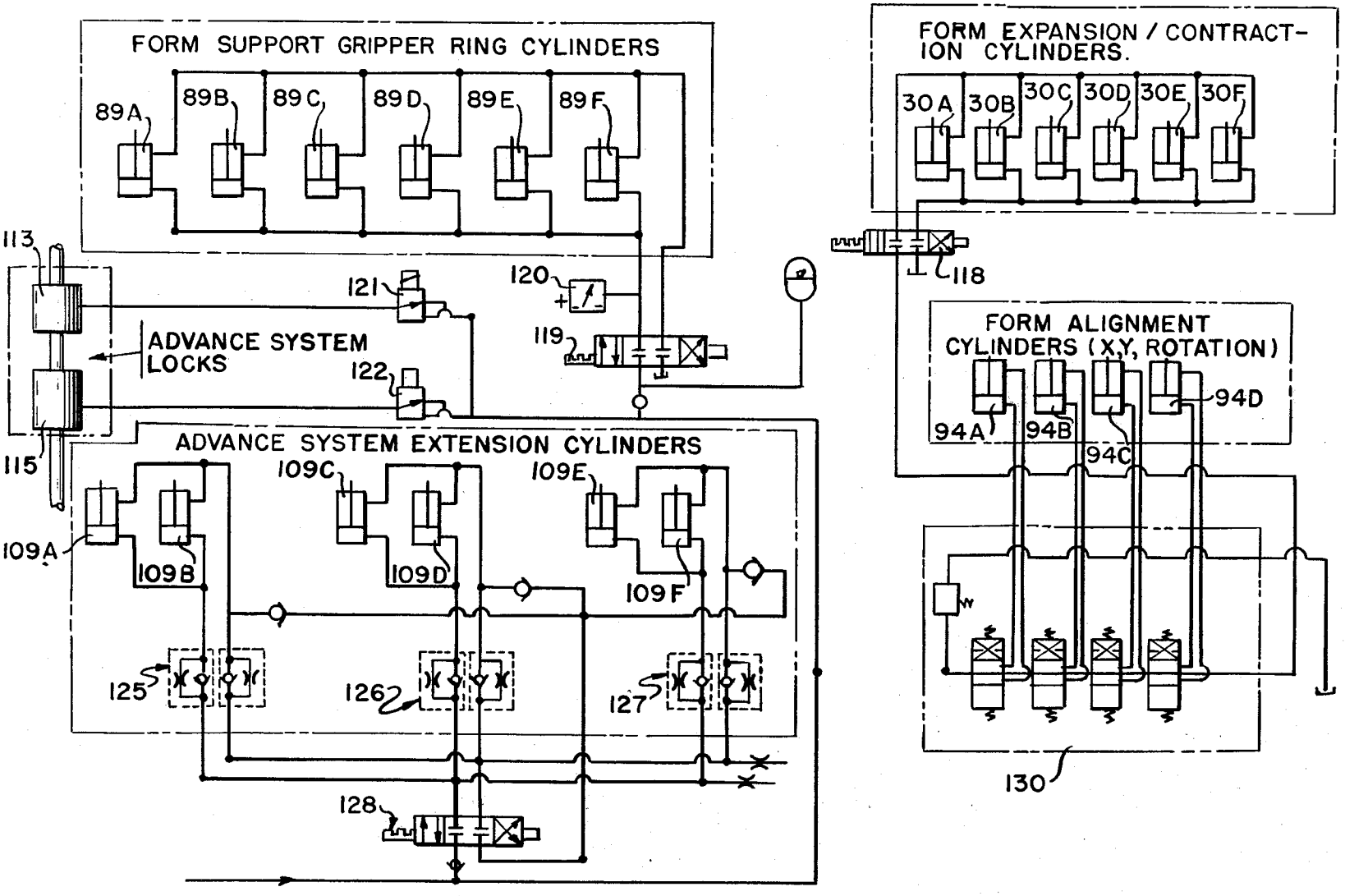
FIG. 17 is a schematic diagram of the hydraulic control system for the apparatus of the invention.

The other three adjusting cylinders are not shown in FIG. 4 for brevity, but they are schematically illustrated in a control diagram of FIG. 17 where they are designated 94B–94D respectively. The cylinder 94B of FIG. 17 has its rod end connected to the gripper ring assembly at the one o'clock position of FIG. 5, and its axis extends counter-clockwise about the circumference of the curb ring where its butt end is anchored to the curb ring. Similarly, the cylinder 94C is located at the three o'clock position in FIG. 5, and the cylinder 94D is located at the six o'clock position in FIG. 5.

If all four cylinders 94A–94D are extended uniformly, the curb ring (and hence the bottom of the retainer form) is rotated clockwise relative to the gripper ring. Similarly, if the adjusting cylinders are retracted uniformly, the curb ring is rotated counter-clockwise. If cylinders 94A and 94C alone are adjusted, the curb ring is adjusted along the Y axis (vertical direction) of FIG. 5. If only the cylinders 94B and 94D are adjusted, the curb ring is adjusted along the X (horizontal) direction of FIG. 5.

E. Advancing System and Column Locks

As indicated above, the form support gripper ring 19 is supported by three advancing assemblies generally designated 15 in FIG. 1 and spaced at one hundred and twenty degree intervals about the circumference of the shaft. Each of these advancing assemblies is similar. Turning then to FIG. 11, the advancing assembly 16 is seen in more detail as including a column or rod 16A which is telescopically received in a spacer tube 16B. The upper end of the column 16A is formed into a ball designated 102 which is mounted in a socket generally designated 103. The socket is secured to a plate 104 which, in turn, is secured to the bottom of the lower ring 82 of the gripper ring assembly.

The lower end of the spacer tube 16B is welded to a mounting pad 105 on the gripper ring 11 (shown only diagrammatically in FIG. 11) of the blind shaft borer. The gripper ring 11 of the blind shaft borer identified above has to be modified to accommodate the mounting plate 105 and to permit the column 16A to pass through it when the form support gripper ring 19 is lowered.

A pair of braces 107, 108 are welded to opposite sides of the upper portion of the spacer tube 16B; and the butt ends of hydraulic cylinders 109A, 109B are pivotally mounted respectively to the braces 107, 108. The rod ends of the cylinders 109A, 109B are pivotally connected to a yoke 111 which is secured to the column 16A.

A first column lock (sometimes referred to as the "upper" column lock) generally designated by reference numeral 113 is secured to the yoke 111 and receives the column 16A. A lower column lock generally designated 115 is secured to the interior of the top of the spacer tube 16B and also receives the column 16A. The locks 113, 115 may be of a type known in the industry as "Bear-Loc", models 3000-5 and 3000-36 respectively, sold by York Industries of York, Pa. Both locks may be provided on a common rod having a diameter of five and one-half inches. Briefly, each of the locking devices includes a sleeve which forms an interference fit with the associated support column, together with end caps through which hydraulic fluid under pressure is introduced. The pressurized fluid expands the sleeve radially, thereby allowing the lock to slide over the column.

In the advancing system, since there are three column assemblies, there are four hydraulic cylinders in addition to those designated 109A and 109B as shown in FIG. 11. These six cylinders of the advancing system are designated respectively 109A–109F in the hydraulic schematic of FIG. 17. In addition, an upper and a lower lock are shown in FIG. 17 and designated 113 and 115 respectively. All of the upper and all of the lower locks may be connected in parallel circuit hydraulically.

F. Hydraulic Control System

Turning now to FIG. 17, the hydraulic cylinder and piston rod units as well as the locks for the advancing system which have already been identified have corresponding reference numerals in FIG. 17. The six hydraulic cylinders used to expand and contract the retainer form comprise six double-acting cylinders 30A–30F controlled by a three-position four-way, manually controlled directional control valve 118. Each of these cylinders has a six inch stroke, and the cylinders bottom out when the form reaches a diameter of twenty-two feet.

The form support gripper ring expansion cylinders 89A-89F provide the gripper force to hold the form and curb ring secured to the shaft wall. These cylinders are controlled through a manually operated three-position, closed center, four-way, directional controlled valve 119. A pressure switch 120 is located in the hydraulic line on the upstream side of the valve 119 to provide an interlock with the upper and lower lock circuits. The upper and lower lock circuits are controlled by two valves designated 121 and 122. These may be two-position, three-way, permissible solenoid-controlled, directional control valves. The solenoid valves are electrically interlocked with the form support gripper circuit in such a manner that neither lock can be released unless the form support gripper ring is also released.

The hydraulic cylinders 10A-1F which are used to advance the form are controlled by three pairs of flow-control valves 125, 126 and 127 respectively and a four-way, manually operated directional control valve 128.

The circuit comprising the form alignment cylinders 94A–94D is controlled by a directional controlled stack valve having both an inlet and an outlet section and four mid-sections, each of which can be independently controlled. This valve is enclosed within the chain line 130 of FIG. 17. Each midsection is connected to one of four of the double-acting cylinders 94A–94D. By combining or independently operating the controls, the rotational or horizontal translational motion of the form described above can be effected.

G. Operation and Method

After the boring machine has completed the second of two thirty-inch boring strokes, the boring machine gripper ring 11 is expanded to re-grip the wall of the shaft in preparation for the next boring stroke. At this time, the concrete of the most recently poured liner segment is self-supporting, but the form support gripper ring 19 is also in gripping relation with the wall of the shaft. The upper and lower locks 113, 115 are released by energizing the solenoid valves 121, 122 of FIG. 17. This state is illustrated in FIG. 11. It will be observed at the top of column 16 cut away. That is, the form support gripper ring at this time will normally be well above the column support and locking assembly 16.

Next, the support columns are gripped by the lower locks 115 attached to the spacer tube 16B which is mounted on the gripper ring of the boring machine. This is diagrammatically illustrated by darkening the lower lock 115 in FIG. 14. The upper lock 113 remains in the released condition. Next, the form support gripper ring is retracted by operation of the control valve 119 of FIG. 17, and this transfers the weight of the form (including curb ring and form support gripper ring) to the boring machine gripper ring to the column 16A, lower lock 115 and support tube 16B.

Next, the hydraulic cylinders 109A–109F are extended by means of the control valve 128 to the position shown in FIG. 15. When the hydraulic cylinders of the advancing system are thus extended, the upper locks 113 are actuated (by shutting off the flow of pressurized fluid by means of the valve 121) so that these locks grip the support columns at an upper position.

Then, the lower locks 115 are released, transferring load to the upper locks 113 and hydraulic cylinders 109A-109F.

With the upper locks continuing in their gripping relation, the cylinders 109A-109F may be retracted simultaneously to lower the retainer form and form support gripper ring. Obviously, before the retainer form is lowered, it will have been broken away from the previously poured concrete segment by retracting the cylinders 30A-30F by means of valve 118.

When the cylinders 109A-109F are retracted from the position in FIG. 15 to that of FIG. 16, the lower locks 115 are caused to grip the column 16A, and after a time delay, the upper locks are released.

If, for purposes of illustration, the stroke of the cylinders 109A-109F is twelve inches, and it is desired to move the retainer form five feet, this complete cycle will have to be completed five times. The advance system will accommodate a total advance of up to fifteen feet without re-gripping the boring machine.

In order to provide a safety in the event of a failure of hydraulic power, back-up hydraulic power from an accumulator associated with the form support gripper system is utilized to maintain form support gripping pressure against the wall of the shaft, and the locks 113 and 115 will grip the support columns if hydraulic pressure is lost.

Having thus disclosed in detail a preferred embodiment of the invention, persons skilled in the art will be able to modify certain of the structure disclosed and to substitute equivalent steps while continuing to practice the principle of the invention; and it is, therefore, intended that all such modifications and substitutions be covered as they are embraced within the spirit and scope of the appended claims.

The embodiments of the invention in which an exclusive property or privilege is claimed are defined as follows:

1. Apparatus for forming contiguous sections of a concrete liner in a vertical shaft in cooperation with a boring machine comprising:

retainer form means including an expandable cylindrical form having first and second overlapping edges;

first power means for moving said expandable form selectively between a first position of expanded circumference and a second position of contracted circumference;

curb means including sealing means at the bottom of said expandable form for forming a lower edge of a concrete section poured between said form and the wall of said shaft;

gripper means for frictionally engaging the wall of said shaft for supporting said retainer form means independently of said boring machine;

adjusting means for adjusting said panel means relative to said gripper means for rotational and translational motion, whereby said gripper means can be placed in gripping relation with the wall of said shaft and said panel means can be adjusted relative to said gripper means; and advancing means interconnecting said gripper means and said boring machine for lowering said form means toward said boring machine while supporting the weight of said form means on said boring machine.

2. The apparatus of claim 1 wherein said form includes an outer sheath of sheet material overlapped on itself to provide an outer lap and an inner lap, said outer lap and said inner lap cooperating to seal against the flow of concrete when a section of said liner has been poured between sheath and the wall of said shaft.

3. The apparatus of claim 2 wherein the end of said outer lap of said form is beveled, the leading edge of said beveled end being adjacent the outer surface of said inner lap to define a knife edge for cutting concrete away from the outer surface of said inner lap when said form is contracted.

4. The apparatus of claim 3 wherein said beveled portion of said outer lap is formed on a bias relative to a line parallel to the axis of said form.

5. The apparatus of claim 2 wherein said sheath is formed of individual panels, each panel including a portion of said sheath having side edges parallel to the axis thereof and a height extending the full height of said form; each panel further including reinforcing means; and means for connecting adjacent panels together while permitting said lapped edges to move relative to one another.

6. The apparatus of claim 1 wherein said first power means interconnects said lapped edges of said sheath for moving the same relative to one another while permitting said edges to maintain said seal in the expanded position.

7. The apparatus of claim 6 wherein said first power means comprises a plurality of hydraulic cylinders having their axes extending generally circumferentially of said form and each having one end connected to said outer lap and the other end connected to the inner lap of said form; and wherein the expanded position of said form is defined by the bottoming out of the plungers of said hydraulic cylinders.

8. The apparatus of claim 5 wherein each of said panels comprises a plurality of fill ports including at least one such port at two different elevations on each panel for facilitating the pouring of concrete in the space between said form and the wall of said shaft.

9. The apparatus of claim 8 wherein said fill ports are defined by apertures in said sheath of said form and wherein each fill port includes a section of a fill pipe having a discharge end welded to said sheath adjacent to an associated aperture and extending upwardly from said aperture and toward the center of said shaft to facilitate drainage of concrete into said liner.

10. The apparatus of claim 9 further comprising removable cap means for each of said fill pipes and having an end surface continuing the outer surface of said sheath when inserted in an associated fill pipe.

11. The apparatus of claim 10 wherein said fill ports are adapted to receive vibrators for immersion into concrete poured into a liner section; said apparatus further comprising a plurality of panel vibrators mounted to the inner surface of said sheath at angularly displaced locations for enhancing the bond of said concrete to the wall of said shaft.

12. The apparatus of claim 1 wherein said curb means includes a curb ring; and means for connecting said curb ring to the bottom of said form, said curb ring extending downwardly and outwardly from the bottom edge of said form.

13. The apparatus of claim 12 wherein said curb ring defines a surface having a generally frusto-conical shape to form the lower edge of a poured liner section and thereby facilitate the escape of air during the pouring of a lower liner section, such escape of air being upwardly and toward the center of said shaft.

14. The apparatus of claim 12 wherein said sealing means comprises an inflatable seal of toroidal shape having an outer cylindrical surface of flexible material adapted to frictionally engage the wall of said shaft when said seal means is inflated.

15. The apparatus of claim 14 wherein said curb ring further defines an annular peripheral recess adapted to receive said inflatable seal in sealing engagement.

16. The apparatus of claim 12 further comprising means for connecting the lower portion of said expandable form to said curb means for permitting said form to expand and contract relative to said curb means.

17. The apparatus of claim 16 wherein said curb ring includes an upper horizontal flange extending inwardly of the top thereof and wherein the bottom of said expandable form includes an inwardly extending horizontal flange adapted to rest on and slide along said horizontal flange of said curb ring; and wherein said connecting means includes a plurality of clamps connected to one of said horizontal flanges and including means for limiting the outward radial motion of the other of said flanges.

18. The apparatus of claim 17 further comprising pin connection means for connecting said curb ring to said form for limiting relative rotation between them while permitting said form to expand and contract relative to said curb ring.

19. The apparatus of claim 1 wherein said adjusting means for adjusting said form relative to said gripper means includes a plurality of second hydraulic cylinders arranged with their axes extending generally circumferentially of said form and having one end thereof connected to said gripper means, and the other end thereof connected to said curb means.

20. The apparatus of claim 1 further comprising first and second alignment means, each alignment means including a plurality of tubular sections; means for connnecting said sections together while maintaining a substantially uniform outer diameter of the abutting edges of said sections, said sections being received through said curb means at a location between said form means and said wall of said shaft; said apparatus further comprising means for sealing said tube sections to said curb ring while permitting said tube sections to slide through said ring as said form means is lowered, whereby when said adjusting means adjusts said form means in rotation or translational motion, the lower ends of the free portion of said tube sections are also adjusted.

21. The apparatus of claim 1 wherein said advancing system includes a plurality of column adjusting mechanisms based about the periphery of said form support gripper means, each of said column adjusting assemblies comprising vertically extensible power means whereby said form support gripper ring means may be adjusted in a horizontal plane using the gripper ring of said boring machine as a reaction base.

22. The apparatus of claim 21 wherein each of said column assemblies includes a vertical column; means for connecting the top of said column to said form support gripper means while permitting universal motion of said column over a limited range; spacer tube means connected to said gripper ring of said boring machine and telescopically receiving said column; hydraulic cylinder means having one end connected to said spacer tube means; means for connecting the other end of said hydraulic cylinder means to said column above said spacer tube; first lock means for selectively locking said column to said connecting means of said hydraulic cylinder means; and second locking means for selectively locking said column to said spacer tube means.

23. Apparatus for supporting a form for retaining concrete during the formation of a concrete liner in a vertical shaft and for advancing said form down said shaft behind a boring machine having first gripper means for supporting said boring machine by frictional engagement with the wall of said shaft, comprising:

second gripper means connected to said form and including power actuation means for frictionally engaging the wall of said shaft and for supporting said form independent of said boring mechine; an advancing mechanism including a plurality of telescoping column assemblies, each including a column connected to one of said gripper means; a spacer tube receiving an associated column telescopically and connected to the other of said gripper means; vertically actuatable hydraulic cylinder means having one end connected to one of said column and spacer tube means; first selectively actuatable lock means for locking the other end of said hydraulic cylinder means to the other of said column and spacer tube means; and second selectively actuatable lock means for selectively locking said column to said spacer tube means.

24. A method of forming a concrete liner section about the periphery of a vertical shaft comprising:

supporting a boring machine beneath said form by engagement with the walls of said shaft;

constricting the circumference of a radially-expandable cylindrical retainer form to a diameter less than the inner diameter of the liner;

locating said form axially of said shaft at the elevation of the desired liner section;

expanding said form to define a liner space with the wall of said shaft;

attaching said form to said wall so that it is self-supporting;

filling said liner space with a quick setting concrete; and transferring the weight of said form to said boring machine after said concrete is self-supporting to the desired location of a subsequent liner section.

25. The method of claim 24 wherein it is desired to form said liner sections at an advance rate down said shaft commensurate with the advance rate of said boring machine; and wherein said step of transferring weight to said boring machine includes: gripping the wall of said shaft with gripper means of said boring machine; releasing form support gripper means supporting said form; interlocking vertically extensible column support assembly means between said form and said gripping means of said boring machine; breaking said form away from said previously set concrete; reducing the extension of said vertically extensible column support means to thereby lower said form support gripper means and said form down said shaft; and re-attaching said form support gripper means to the wall of said shaft when it has been moved to the desired axial location.

26. The apparatus of claim 25 further including the steps of joining sections of alignment tubes by extending them in said liner space through said form while sealing said tubes with said form against the flow of concrete; adjusting the bottom of said form in elevation, rotation, and translation to attain vertical alignment of said tubes; and then embedding said tubes in said liner section being formed.

* * * * *